US006196874B1

(12) United States Patent
Wu

(10) Patent No.: US 6,196,874 B1
(45) Date of Patent: Mar. 6, 2001

(54) PLUG CONNECTOR HAVING ADDITIONAL POWER PLUG FOR TRANSMITTING HIGH RATED POWER

(75) Inventor: Kun-Tsan Wu, Tu Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/219,544

(22) Filed: Dec. 22, 1998

(30) Foreign Application Priority Data

Jun. 2, 1998 (TW) ..... 87208643

(51) Int. Cl.[7] ..... H01R 13/648
(52) U.S. Cl. ..... 439/607
(58) Field of Search ..... 439/607, 610, 439/701, 92, 608, 609; 174/35

(56) References Cited

U.S. PATENT DOCUMENTS 4,659,163 * 4/1987 Althouse et al. ..... 359/387
5,397,246 * 3/1995 Defibaugh et al. ..... 439/352
5,518,428 * 5/1996 Onada ..... 439/752
5,637,015 * 6/1997 Tan et al. ..... 439/607

* cited by examiner

*Primary Examiner*—Brian Sircus
*Assistant Examiner*—Chandrika Prasad
(74) *Attorney, Agent, or Firm*—Wei Te Chung

(57) ABSTRACT

A plug connector comprises a first dielectric housing (1), a first connector (2), a second connector (3), a metal plate (4), a push button (5), a second dielectric housing (6), and a cable strain release cap (7). The first connector (2) includes an EMI shield (21) surrounding first and second insutators (22, 24) assembled together and receiving four contact pins (23) therein. The first connector (2), the second connector (3), and the metal plate (4) are inserted into corresponding channels (12, 13 and 11) defined through the first housing (1) and extend beyond the mating face (14) thereof. The second housing (6) is assembled (to) the first housing (1) and the cap (7) engages with the second housing (6). When the plug connector is inserted into a panel of a computer system, a ground path is established from the housing of the computer system through the metal plate (4) and the shield (21) to the second connector (3). The second connector (3) provides a path for signal transmission while the first connector (2) is reserved for power transmission.

17 Claims, 11 Drawing Sheets

PLUG CONNECTOR HAVING ADDITIONAL POWER PLUG FOR TRANSMITTING HIGH RATED POWER

BACKGROUND OF THE INVENTION

1. Field of The Invention

The present invention relates to a plug connector, and more particularly to a plug connector having an additional power harness assembly.

2. The Prior Art

A Universal Serial Bus (USB) is an existing data transmission standard. Many telecommunication devices, such as computers and peripherals thereof, utilize USBs for data transmission. USBs feature a higher data transmission speed than conventional RS232 connectors. Additionally, USBs reduce the required number of wire harnesses between devices thereby facilitating configuration of a system and maintenance thereof.

The standard USE connector includes four contact pins. Two contact pins are reserved for signal transmission and the other two are reserved for power transmission between devices. However, some applications require high rated power and an additional power plug is required. Since the additional power plug is assembled to an exterior of the connector, the power plug is vulnerable to damage caused by an undesired pulling force. Therefore, the present invention introduces an attaching arrangement for assembling the power plug to an interior of the plug connector.

SUMMARY OF THE INVENTION

Accordingly, the objective of the present invention is to provide a plug connector having additional power contact pins which provide power supply to a system requiring high rated power. The plug connector in accordance with the present invention can be applied to other cable harness assemblies, such as the IEEE 1394 connector.

To fulfill the above objective, a plug connector in accordance with the present invention comprises a first dielectric housing, a first connector, a second connector, a metal plate, a push button, a second dielectric housing, and a cable strain release cap. The first connector includes an EMI shield surrounding first and second insulators assembled together and receiving four contact pins therein. The first connector, the second connector, and the metal plate are inserted into corresponding channels defined through the first housing and extend beyond the mating face thereof. The second housing is assembled to the first housing and the cap engages with the second housing. When the plug connector is inserted into a panel of a computer system, a ground path is established from the housing of the computer system through the metal plate and the shield to the second connector. The second connector provides a path for signal transmission while the first connector is reserved for power transmission.

These and additional objectives, features, and advantages of the present invention will become apparent after reading the following detailed description of the preferred embodiment of the invention taken in conjunction with the appended drawing figures.

DETAILED DESCRIPTION OF THE PREFERRED EMBODIMENT

Detailed reference will now be made to the preferred embodiment of the present invention.

Figure 1:
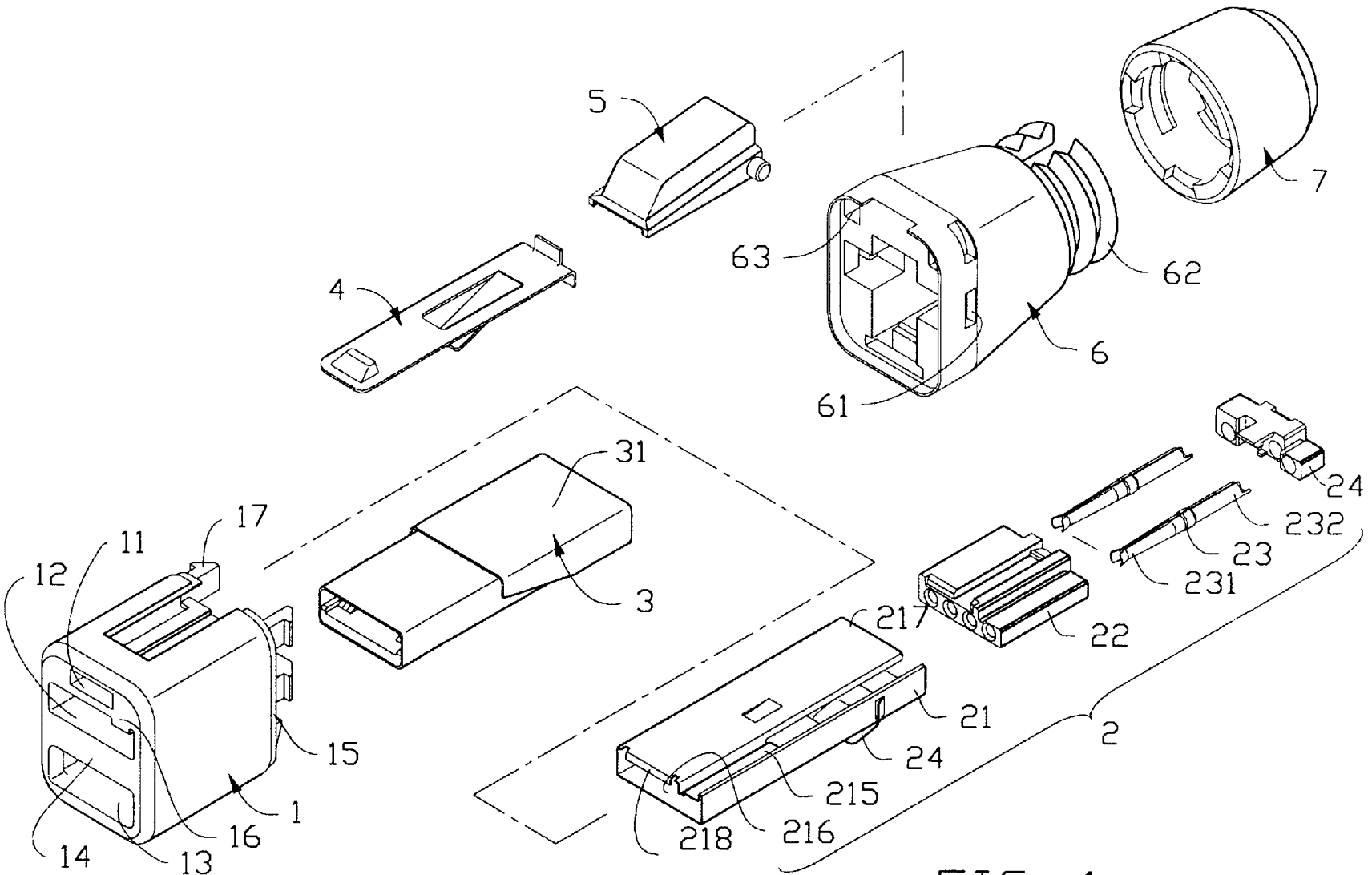
FIG. 1 is an exploded view of a plug connector in accordance with the present invention.

Referring primarily to FIG. 1, a plug connector in accordance with the present invention comprises a first dielectric housing 1, a first connector 2, a second connector 3, a metal plate 4, a push button 5, a second dielectric housing 6, and a cable strain release cap 7.

Figure 2:
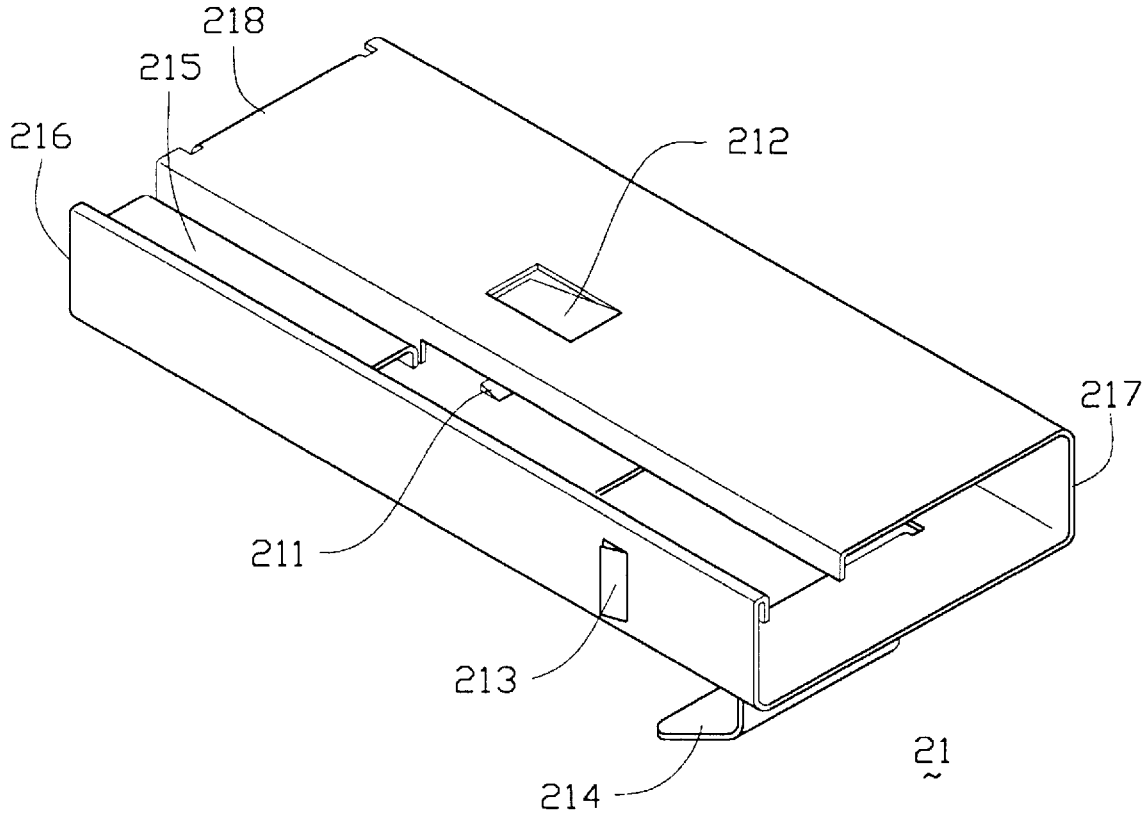
FIG. 2 is a perspective view of an EMI shield used with the plug connector.

The first connector 2 comprises an EMI shield 21 surrounding first and second insulators 22, 24 which receive four contact pins 23 therein. Each contact pin 23 includes a head portion 231 and a tail 232. Referring also to FIG. 2, the EMI shield 21 forms spring tabs 211, 212, 213 on outer surfaces thereof and a grounding plate 214 extending downward therefrom. An aligning slot 215 is defined in a top surface of the shield 21 adjacent to one side between front and rear ends 216, 217 thereof. An inclined portion 218 extends downward from a top face at the front end 216 thereof.

Figure 3:
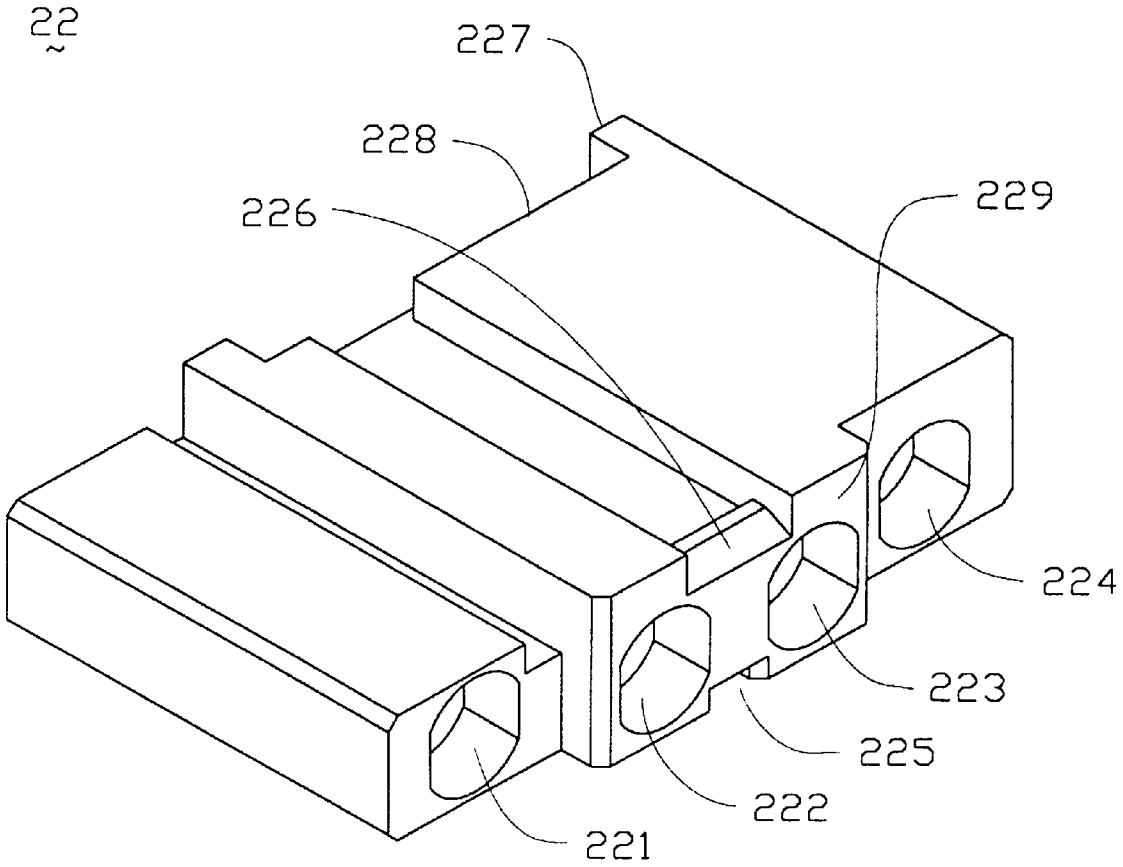
FIG. 3 is a perspective view of a first insulator used with the plug connector.
Figure 4:
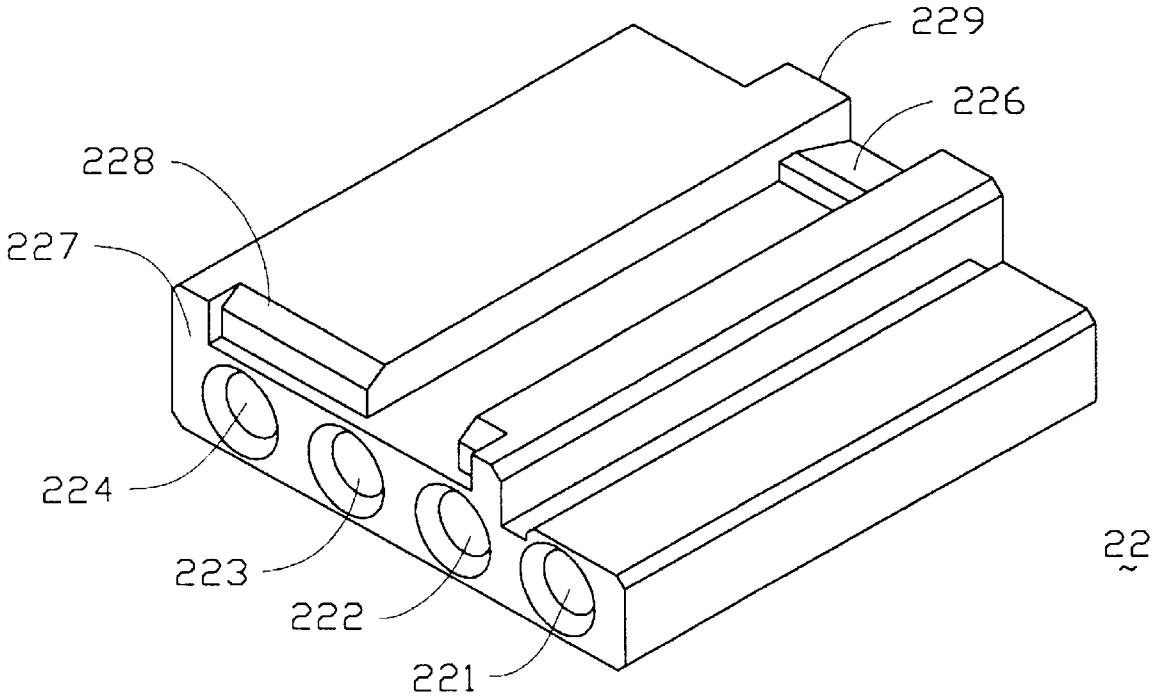
FIG. 4 is a view similar to FIG. 3 taken from a different angle.

The first insulator 22 is clearly shown in FIGS. 3 and 4 and defines four passageways 221, 222, 223, 224 therethrough between front and rear faces 227, 229 thereof. A sloped face 228 downwardly extends from an upper front edge thereof toward the front face 227. A slot 225 is defined along a bottom surface of the first insulator 22 and an inclined wedge 226 extends from a top surface thereof.

Figure 5:
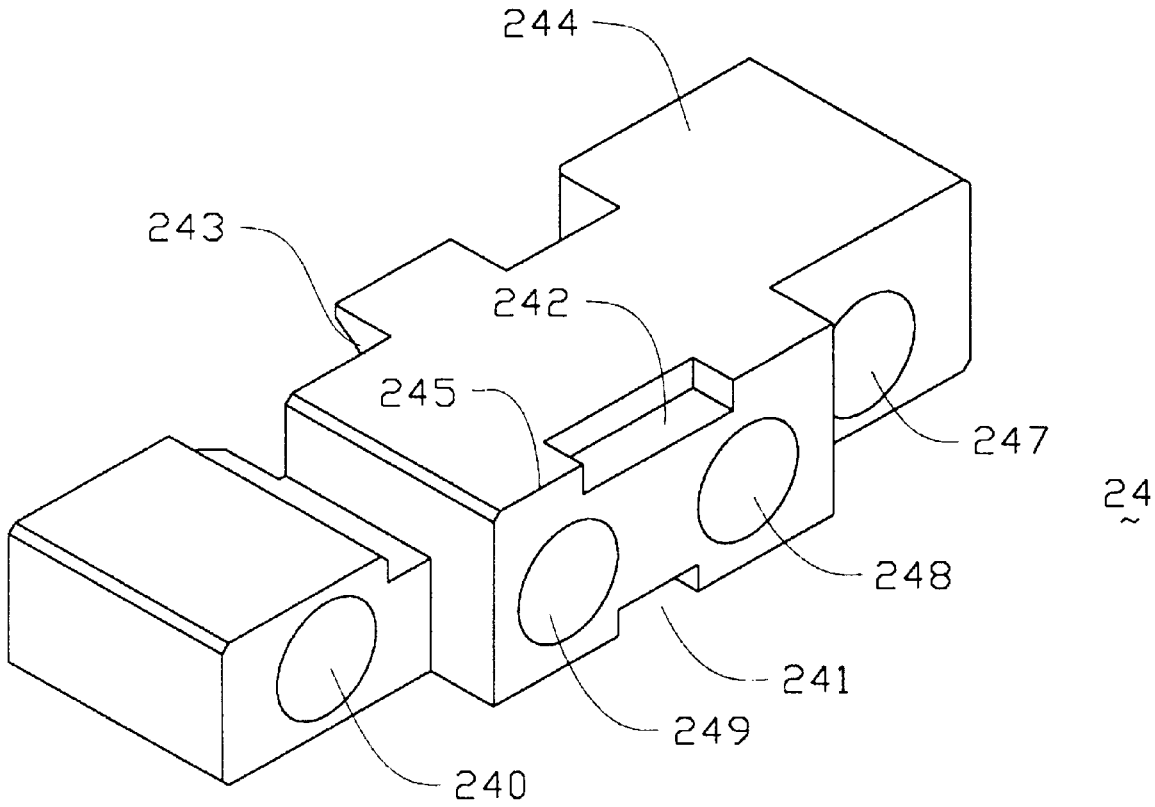
FIG. 5 is a perspective view of a second insulator used with the plug connector.
Figure 6:
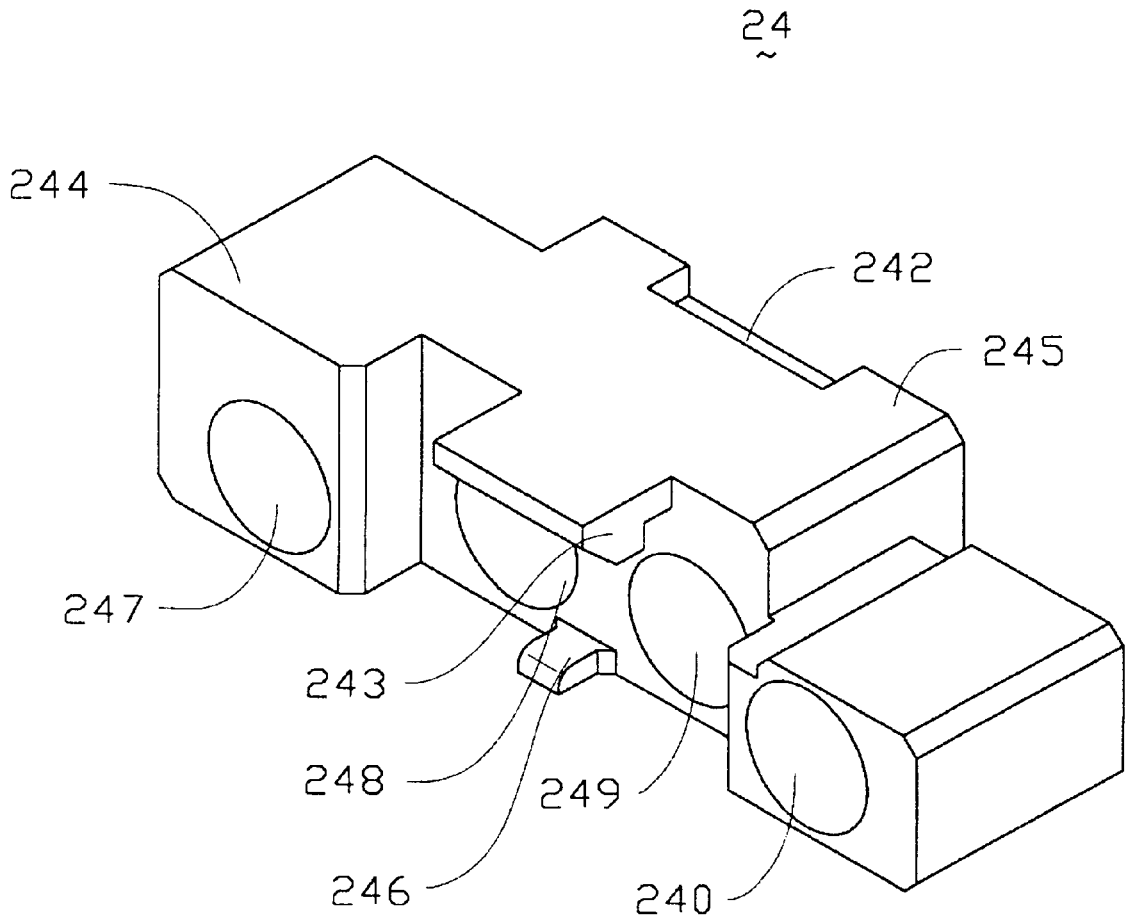
FIG. 6 is a view similar to FIG. 5 taken from a different angle.

FIGS. 5 and 6 show the second insulator 24. Passageways 247, 248, 249, 240 are defined therethrough between front and rear faces 244, 245 thereof. A step 242 is defined in a top surface of the second insulator 24 exposed to the rear face 245 thereof. A hook 243 extends from a top portion of the front face 244 and a tab 246 extends from a lower portion thereof.

Figure 7:
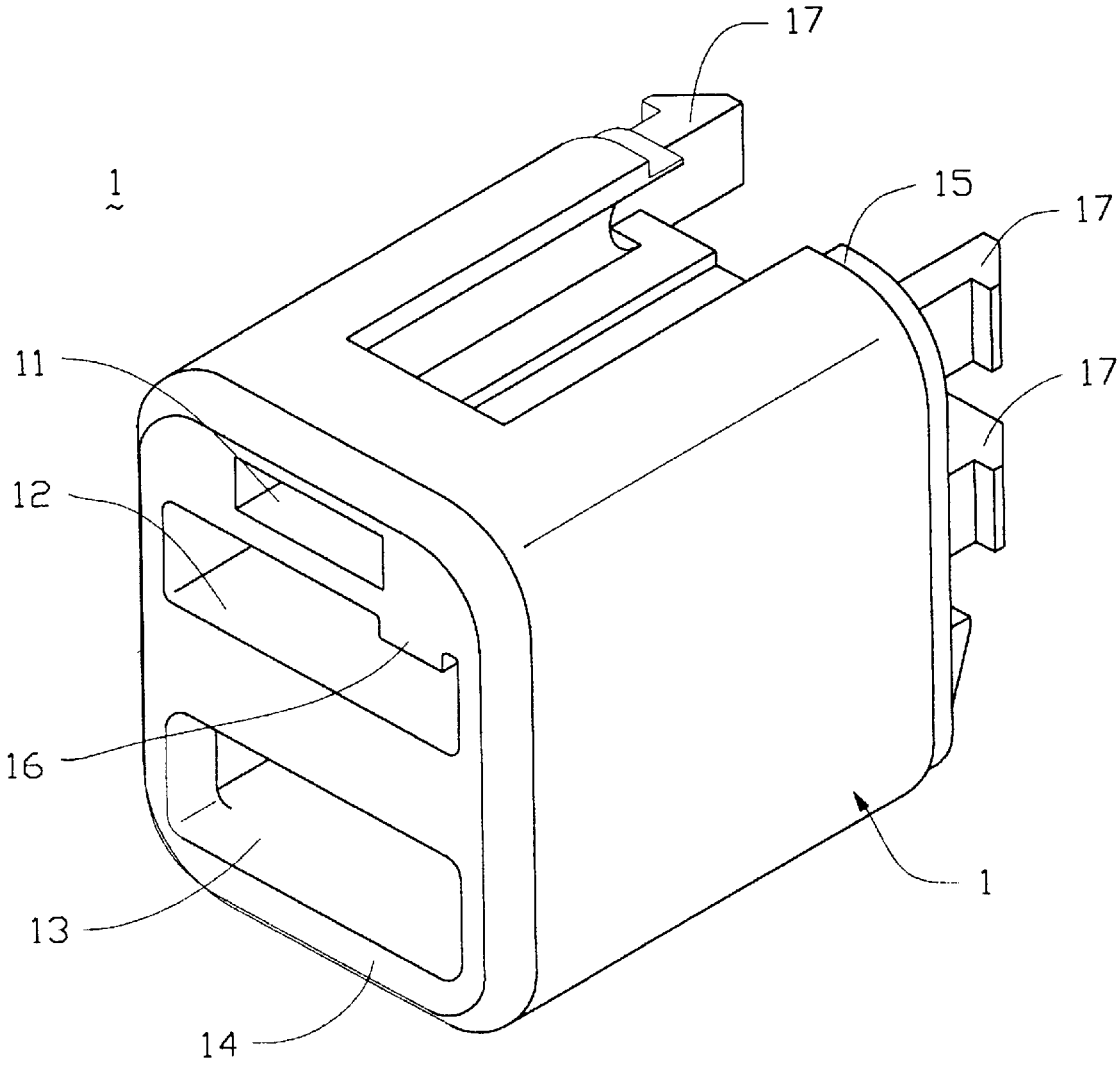
FIG. 7 is a perspective view of a first dielectric housing used with the plug connector.

The first dielectric housing 1, as seen in FIG. 7, defines upper, middle, and lower channels 11, 12, 13 between mating and rear faces 14, 15 thereof. Four hooks 17 extend from the rear face 15. A key 16 projects downward into the middle channel 12 adjacent to one side thereof.

Figure 8:
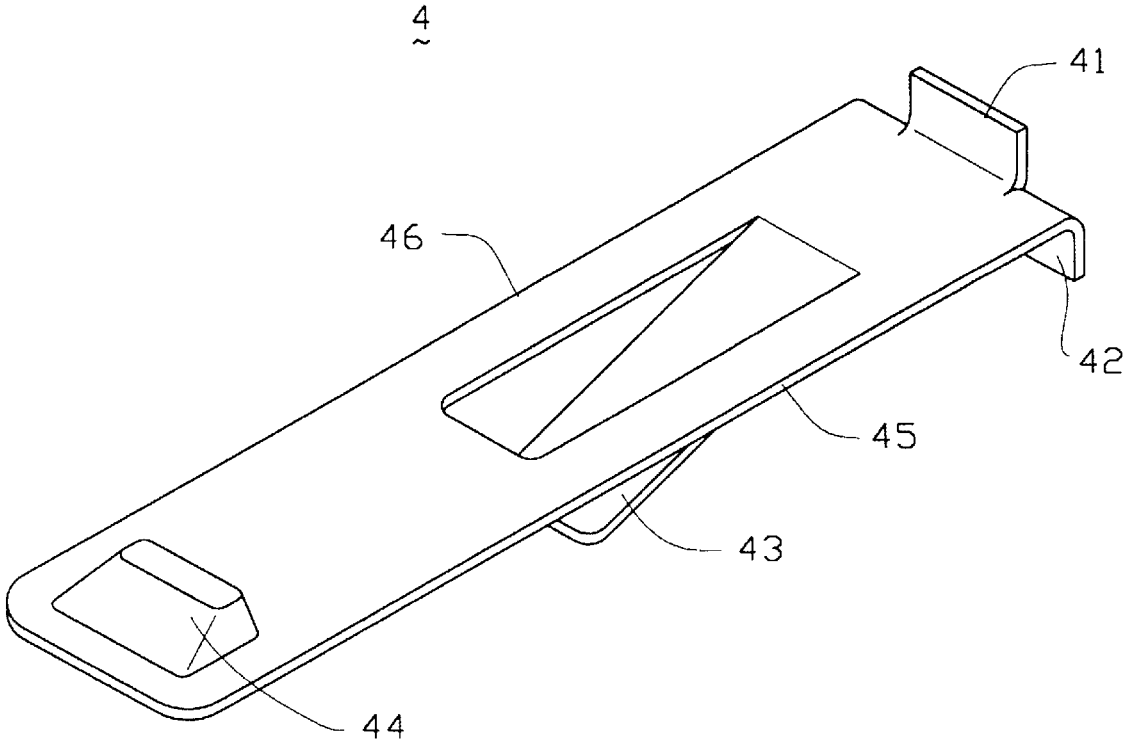
FIG. 8 is a perspective view of a metal plate used with the plug connector.

Referring to FIG. 8, the metal plate 4 is formed by a stamping and bending process to have retaining tabs 41, 42 projecting in opposite directions from one end thereof and a locking embossment 44 projecting upwards from an opposite end thereof. A resilient tab 43 projects downward from a middle portion thereof.

Figure 9:
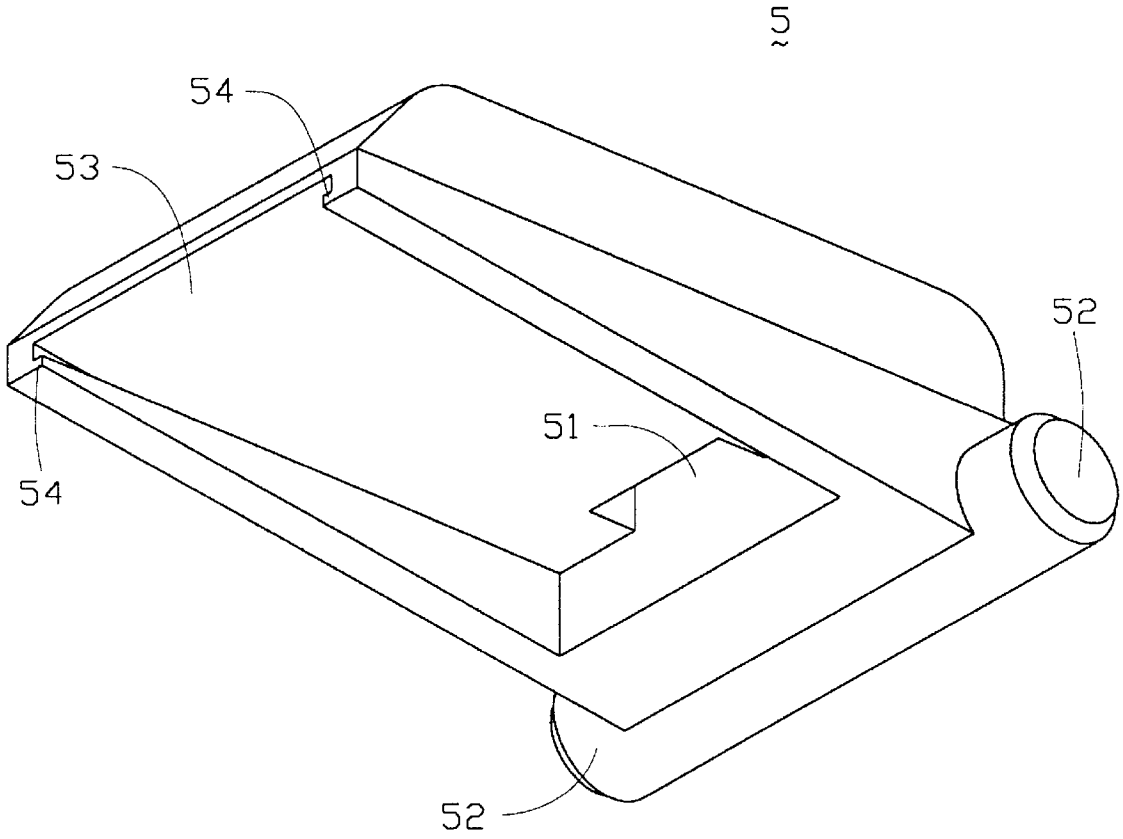
FIG. 9 is a perspective view of a push button used with the plug connector.

The push button 5 shown in FIG. 9 defines a guiding slot 53 in a bottom face and exposed to one end thereof. Grooves 54 are defined in opposite inner sides of the button 5 exposed to the slot 53. A mounting shaft 52 is formed along an opposite end of the button 5. A recess 51 is further defined in the bottom face of the button 5 in communication with the guiding slot 53.

Figure 10:
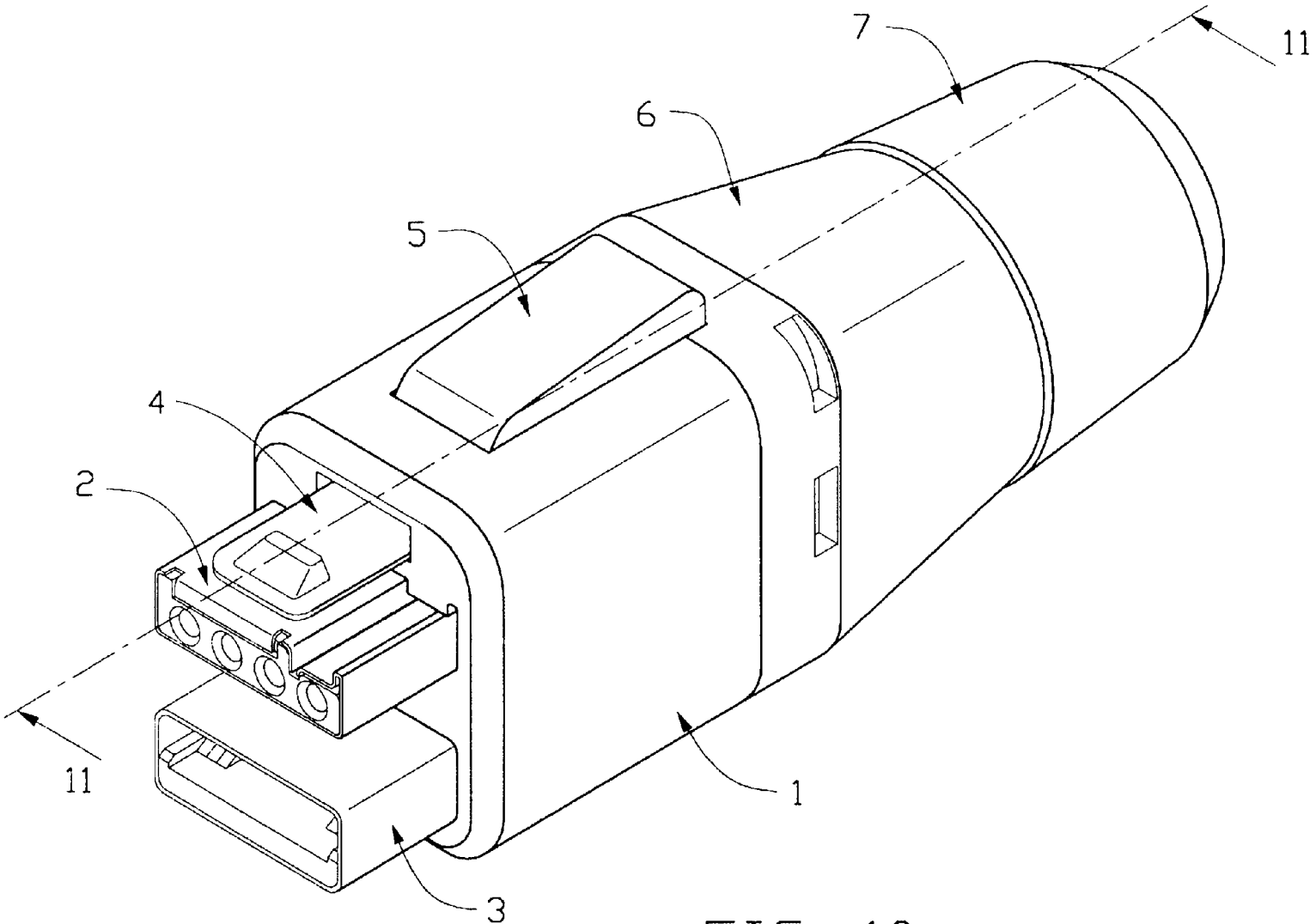
FIG. 10 is an assembled view of FIG. 1.
Figure 11:
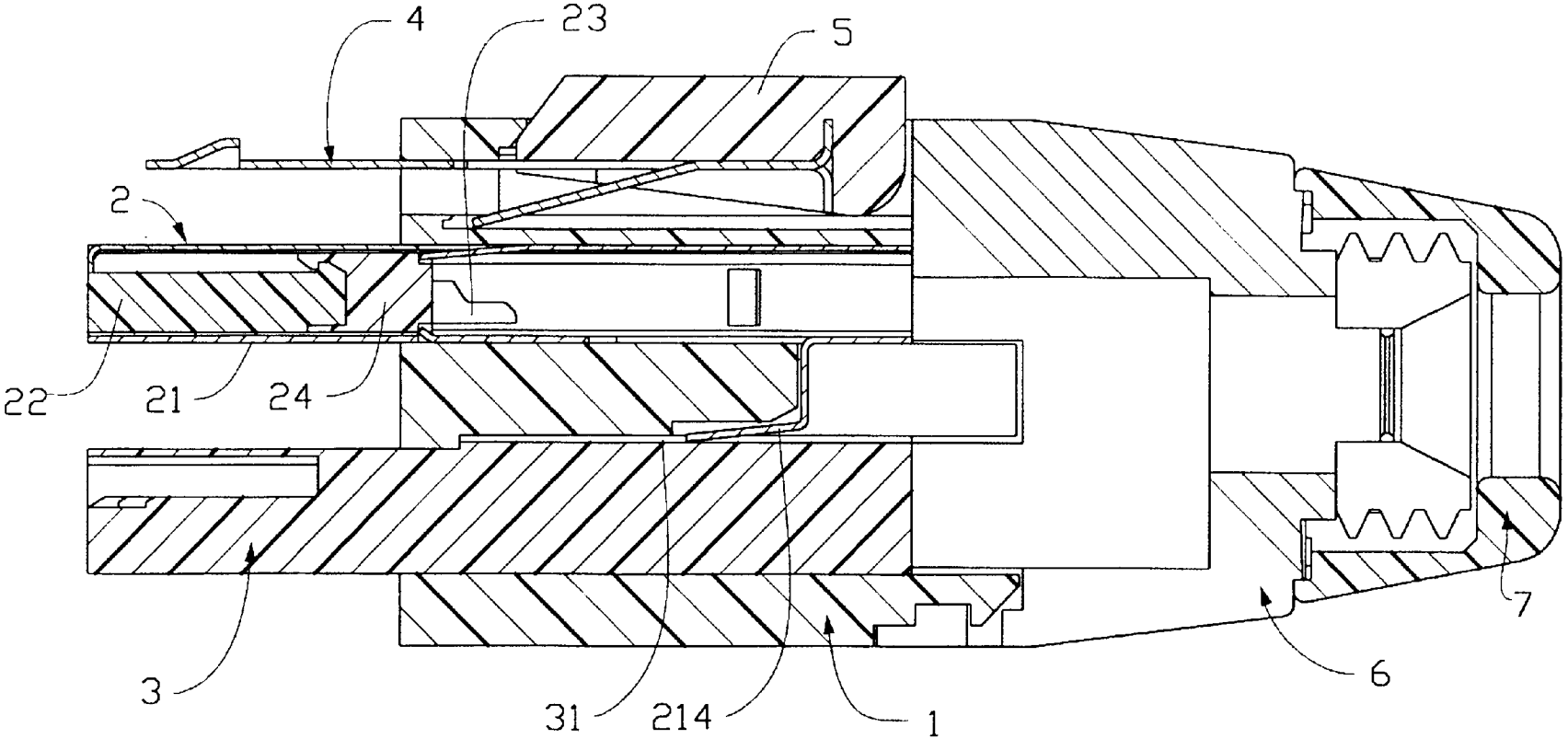
FIG. 11 is a cross sectional view taken along line XI—XI of FIG. 10.

In assembly as seen in FIGS. 10 and 11, the contact pins 23 are sandwiched between the first and second insulators 22, 24, whereby the head portions 231 of the contact pins 23 are received in the corresponding passageways 221, 222, 223, 224 of the first insulator 22 and the tails 232 of the contact pins 23 extend through and beyond the corresponding passageways 247, 248, 249, 240 of the second insulator 24. The insulators 22, 24 are assembled together by engagement between the hook 243 of the second insulator 24 with the wedge 226 of the first insulator 22 and insertion of the tab 246 of the second insulator 24 into the slot 225 of the first insulator 22. The insulators 22, 24 together with the contact pins 23 are inserted into the shield 21 until the inclined portion 218 of the shield 21 abuts against the sloped face 228 of the first insulator 22. The spring tab 212 interferentially engages with the step 242 of the second insulator 24 and the spring tab 212 interferentially engages with the step 241 to ensure stable retention thereof within the shield 21. The first connector 2 is inserted into the middle channel 12 of the first housing 1 and is retained therein by the provision of the spring tabs 213 engaging with recesses (not shown) defined in side walls of the middle channel 12. The provision of the aligning slot 215 and the key 16 prevent disorientation of the first connector 2 within the first housing 1.

The plate 4 is assembled to the button 5 by inserting sides 45, 46 of the plate 4 through the grooves 54 of the button 5 until the retaining tab 41 is received in the recess 51. The second connector 3 is inserted into the lower channel 13 and the metal plate 4 together with the button 5 is inserted into the upper channel 11 of the first housing 1 wherein a ground path is established from the grounding plate 214 of the shield 21 to a top face 31 of the second connector 3 for removal of excessive electric charges accumulated on the surface of the first connector 2. The first connector 2, the second connector 3, and the plate 4 each extend beyond the mating face 14 of the first housing 1 for latchable engagement with the complementary connector assembly. The second connector 3 provides a path for signal transmission while the first connector 2 is reserved for power transmission.

The second housing 6 is assembled to the first housing 1 whereby the hooks 17 of the first housing 1 are received in corresponding retaining recesses 61 defined in the second housing 6. The mounting shaft 52 of the button 5 pivotably engages with a retaining section 63 defined in an upper portion of the second housing 6. The cap 7 engages with a threaded extension 62 of the second housing 6 to complete assembly of the plug connector.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this art are to understand that all such equivalent structures are to be included within the scope of the following claims.

We claim:

1. A plug connector comprising:

a first dielectric housing having a mating face;

a second dielectric housing assembled to the first housing;

a first connector including an insulator receiving a number of contact pins therein and enclosed by an EMI shield for transmission of power through the plug connector; and a second connector for providing a path for signal transmission through the plug connector, said second connector being external to the EMI shield of the first connector and including an external portion for electrically connecting to a grounding circuit;

means for electrically connecting said EMI shield of the first connector and said external portion of the second connector for removing accumulated electric charges on the EMI shield to the grounding circuit;

wherein the first and second connectors are respectively fixedly received in first and second channels defined in the first housing and each connector has a mating portion for mating with a complementary connector, said mating portions extending beyond the mating face of the first housing.

2. The plug connector as described in claim 1, wherein the insulator comprises first and second insulators assembled together, the contact pins being sandwiched between the first and second insulators, whereby head portions of the contact pins are received in corresponding first passageways defined in the first insulator and tails of the contact pins extend through and beyond corresponding second passageways defined in the second insulator.

3. The plug connector as described in claim 2, wherein the first and second insulators are assembled together by engagement between a hook formed on the second insulator and a wedge formed on the first insulator, and by insertion of a tab formed on the second insulator into a slot defined in the first insulator.

4. The plug connector as described in claim 2, wherein the EMI shield forms a spring tab downwardly extending from a top surface thereof, and the second insulator defines a step in a top surface thereof and exposed to a rear face thereof for reception of the spring tab for ensuring stable retention of the second insulator within the shield.

5. The plug connector as described in claim 1, wherein an aligning slot is longitudinally defined in a top surface of the EMI shield and a key projects into the first channel of the first housing for preventing disorientation of the first connector within the first housing.

6. The plug connector as described in claim 1 further comprising a metal plate inserted into a third channel defined in the first housing and extending beyond the mating face thereof, the plate having a resilient tab projecting downward from a middle portion thereof for contacting the EMI shield.

7. The plug connector as described in claim 6 further comprising a push button assembled to the metal plate, wherein a mounting shaft of the button pivotably engages with an upper portion of the second housing.

8. The plug connector as described in claim 1 further comprising a cable strain release cap for engaging with the second housing.

9. The plug connector as described in claim 1, wherein the first housing has a number hooks extending from a rear face thereof for reception in corresponding retaining recesses defined in the second housing.

10. The plug connector as described in claim 1, wherein said means is a grounding plate downwardly extending from the EMI shield for contacting the external portion of the second connector.

11. A plug connector assembly including:

at least one insulative housing receiving a first connector and a second connector therein, each connector having a mating portion for mating with a complementary connector, said mating portions external to the insulative housing;

said first connector providing power transmission and said second connector providing signal transmission; wherein said first connector includes a first shield and said second connector includes an external portion electrically connecting to a grounding circuit, and means for electrically connecting said first shield and said external portion for removing accumulated electric charges on the first shield.

12. The assembly as described in claim 11, wherein said means is a grounding plate integrally extending from the first shield.

13. The assembly as described in claim 11, wherein a locking plate is secured to the housing beside the first connector.

14. The assembly as described in claim 11, wherein the housing defines first, second and third channels for respectively receiving the first connector, the second connector and the locking plate therein.

15. A connector assembly comprising:

a first housing defining two channels;

a second housing coaxially aligned with the first housing;

means for fastening the first housing and the second housing a first connector including a shield enclosing an insulator a second connector including an external portion for electrically connecting to a grounding circuit;

said first and second connectors being spaced from each other and respectively fixedly received in the corresponding channels of the first housing; wherein mating portions of said first and second connectors for mating with complementary connectors extend out of a front mating face of said first housing.

16. A power connector comprising:

a first insulator defining a plurality of juxtaposed first passageways;

a second insulator defining a corresponding number of juxtaposed second passageways in alignment with the corresponding first passageways, respectively;

a corresponding number of contact pins received within said first and corresponding second passageways, respectively;

means for fastening the first insulator and the second insulator together;

a shield enclosing said first and second insulators; and means for securing said first and second insulators with the shield.

17. The connector assembly as described in claim 15, further including a locking metal plate extending parallel to said connectors and beyond the front mating face while not beyond a front end of either connector.

* * * * *